US008791630B2

(12) United States Patent
Maemura et al.

(10) Patent No.: US 8,791,630 B2
(45) Date of Patent: Jul. 29, 2014

(54) LIGHT EMITTING ELEMENT, LIGHT EMITTING DEVICE, VEHICULAR HEADLAMP, ILLUMINATION DEVICE, AND METHOD FOR PRODUCING THE LIGHT EMITTING ELEMENT

(75) Inventors: Yosuke Maemura, Osaka (JP); Yoshiyuki Takahira, Osaka (JP)

(73) Assignee: Sharp Kabushiki Kaisha, Osaka-shi, Osaka (JP)

( * ) Notice: Subject to any disclaimer, the term of this patent is extended or adjusted under 35 U.S.C. 154(b) by 23 days.

(21) Appl. No.: 13/364,539

(22) Filed: Feb. 2, 2012

(65) Prior Publication Data

US 2012/0200218 A1 Aug. 9, 2012

(30) Foreign Application Priority Data

Feb. 3, 2011 (JP) ..... 2011-022021

(51) Int. Cl.
*B05B 5/06* (2006.01)
*H01L 33/50* (2010.01)

(52) U.S. Cl.
USPC ..... 313/501; 313/483; 313/487; 362/84; 362/545; 427/64; 427/71

(58) Field of Classification Search
USPC ..... 313/483–487, 501, 495–497, 582, 313/467–469; 362/84, 545; 427/64–73
See application file for complete search history.

(56) References Cited

U.S. PATENT DOCUMENTS 6,077,458 A * 6/2000 Shiiki et al. ..... 252/301.4 R
7,002,289 B1 * 2/2006 Porter et al. ..... 313/496
2002/0140338 A1 * 10/2002 Sluzky ..... 313/461
2006/0076895 A1 * 4/2006 Wada et al. ..... 313/635
2006/0261723 A1 * 11/2006 Terada et al. ..... 313/485
2007/0001568 A1 * 1/2007 Kaneko et al. ..... 313/112
2007/0221865 A1 * 9/2007 Sohn et al. ..... 250/484.4
2008/0049430 A1 * 2/2008 Sakumoto ..... 362/296
2009/0302235 A1 12/2009 Himmelhaus

FOREIGN PATENT DOCUMENTS

| | | |
|---|---|---|
| JP | 5-54820 | 3/1993 |
| JP | 7-21949 | 1/1995 |
| JP | 10-188899 | 7/1998 |
| JP | 2006-210491 | 8/2006 |
| JP | 2007-294754 | 11/2007 |
| JP | 2009-535604 | 10/2009 |

OTHER PUBLICATIONS

Kitabatake, T. et al. (2010). "The optical and mechanical properties of Eu doped Ca-α-SiAlON phosphor-$SiO_2$ composite films," *Transactions of Materials Research Society of Japan* 35(3):713-716.

* cited by examiner

*Primary Examiner* — Mariceli Santiago
(74) *Attorney, Agent, or Firm* — Morrison & Foerster LLP

(57) ABSTRACT

A light emitting section emits fluorescence upon receiving exciting light emitted from a laser element. The light emitting section includes a plurality of fluorescent material particles made from a single type of fluorescent material or several types of fluorescent materials, the plurality of fluorescent material particles being accumulated on a metal substrate to form a layer of the plurality of fluorescent material particles. Each of the plurality of fluorescent material particles has a surface coated with a coating layer. The coating layer forms an uneven shape of a surface of the light emitting section.

10 Claims, 10 Drawing Sheets

LIGHT EMITTING ELEMENT, LIGHT EMITTING DEVICE, VEHICULAR HEADLAMP, ILLUMINATION DEVICE, AND METHOD FOR PRODUCING THE LIGHT EMITTING ELEMENT

This Nonprovisional application claims priority under 35 U.S.C. §119(a) on Patent Application No. 2011-022021 filed in Japan on Feb. 3, 2011, the entire contents of which are hereby incorporated by reference.

TECHNICAL FIELD

The present invention relates to a light emitting element for emitting fluorescence in response to exciting light with which fluorescent material particles are irradiated, a method for producing the light emitting element, a light emitting device including the light emitting element, a vehicular headlamp, and an illumination device.

BACKGROUND ART

Recently, there has been eagerly studied a technique of emitting fluorescence by irradiating a fluorescent material layer with exciting light emitted from an excitation light source as which a semiconductor light emitting element such as a light emitting diode (LED) or a semiconductor laser (LD; Laser Diode) serves. Typical examples of an excitation light source of a light emitting device encompass (i) an electron gun that is in widespread use for, for example, emission of cathode rays, (ii) a fluorescent lamp that emits ultraviolet rays generated by electric discharge, and (iii) the semiconductor light emitting element. In any light emitting devices, a film of a fluorescent material is ingeniously produced so that the fluorescent material can efficiently emit fluorescence from a fluorescent material layer. Patent Literatures 1 through 4 disclose examples of the light emitting device and a cathode ray tube, each of which includes such a fluorescent material layer.

Patent Literatures 1 and 2 disclose a light emitting device including a fluorescent material layer that includes (i) a light emitting element whose surface has fluorescent material particles thereon or (ii) a glass tube whose inner surface has fluorescent material particles thereon. Patent Literatures 3 and 4 disclose a cathode ray tube including a fluorescent material layer that includes a face glass or a panel substrate whose surface has fluorescent material particles thereon. Non-Patent Literature 1 discloses a technique in which a fluorescent material layer including fluorescent material particles is formed on an ITO substrate.

CITATION LIST

Patent Literatures

Patent Literature 1

Japanese Patent Application Publication, Tokukai, No. 2006-210491 A (Publication Date: Aug. 10, 2006)

Patent Literature 2

Japanese Patent Application Publication, Tokukaihei, No. 10-188899 A (Publication Date: Jul. 21, 1998)

Patent Literature 3

Japanese Patent Application Publication, Tokukaihei, No. 7-21949 A (Publication Date: Jan. 24, 1995)

Patent Literature 4

Japanese Patent Application Publication, Tokukaihei, No. 5-54820 A (Publication Date: Mar. 5, 1993)

Non-Patent Literature

Non-Patent Literature 1

T. Kitabatake, T. Uchikoshi, F. Munakata, Y. Sakka, and N. Hirosaki, "The optical and mechanical properties of Eu doped Ca-α-SiAlON phosphor-$SiO_2$ composite films", Transactions of Materials Research Society of Japan 35 [3] 713-716 (2010)

SUMMARY OF INVENTION

Technical Problem

According to a technique of Patent Literature 1, a fluorescent material layer having a uniform shape is formed by causing fluorescent material particles to be covered with a binding material made from an organic metal material, so that the fluorescent material layer is prevented from having an uneven surface. The uneven surface is made by air bubbles of hydrogen gas left in liquid solution in a case where the fluorescent material particles are deposited by means of electrophoresis. That is, according to the technique of Patent Literature 1, the fluorescent material layer having an even surface is formed by using the organic metal material as the binding material for bonding fluorescent materials. According to a technique of Patent Literature 4, an inorganic coating agent is applied to a surface of a fluorescent material layer, and gaps between fluorescent material particles are filled with a material having a refraction index which approximates that of the fluorescent material particles, whereby the surface of the fluorescent material layer is made even. That is, according to the technique of Patent Literature 4, scattering of light by a fluorescent surface is prevented by filling the gaps between the fluorescent material particles with the inorganic coating agent having the refraction index which approximates that of the fluorescent material particles.

In other words, the techniques of Patent Literatures 1 and 4 are techniques of making the surface of the fluorescent material layer even. In Particular, according to the Patent Literature 4, the scattering of light by the surface of the fluorescent material layer is prevented by making the surface of the fluorescent material layer even.

According to a technique of Patent Literature 2, reflection and scattering of light is prevented by filling gaps between fluorescent material particles with a transparent material having a refraction index substantially equal to that of the fluorescent material particles. According to a technique of Patent Literature 3, a high-density and even fluorescent surface is formed by providing an electrically conductive and high-refractive material layer that serves as an electrode in a case where electrophoresis is employed. According to a technique of Non-Patent Literature 1, $SiO_2$ sol-gel is injected into gaps between fluorescent material particles. That is, according to the technique of Non-Patent Literature 1, the gaps between the fluorescent material particles accumulated by means of electrophoresis are filled with $SiO_2$.

The techniques of these documents disclose using an electron gun, a fluorescent lamp, or an LED as an excitation light source, but do not disclose usage of a laser light source. In a case where, in the techniques, a fluorescent material layer including fluorescent material particles is irradiated with light having a high coherency, such as laser light serving as exciting light, the laser light is possibly reflected by a surface of the fluorescent material layer to be emitted outside while still having a high coherency. This permits human bodies to be highly likely to be in danger of being damaged, for example, human eyes are damaged by the laser light having a high coherency. Note that the light having a high coherency also means light having a great directivity and coherency.

The techniques of these documents do not disclose necessity of reduction in coherency of exciting light at all.

The present invention was made in view of the problems, and an object of the present invention is to provide a light emitting element capable of reducing coherency of exciting light, a light emitting device, a vehicular headlamp, an illumination device, and a method for producing the light emitting element.

Solution to Problem

In order to attain the object, a light emitting element in accordance with an embodiment of the present invention is a light emitting element, for emitting fluorescence upon receiving exciting light emitted from an excitation light source, the light emitting element, including a plurality of fluorescent material particles made from a single type of fluorescent material or several types of fluorescent materials, the plurality of fluorescent material particles being accumulated on a substrate to form a layer of the plurality of fluorescent material particles, each of the plurality of fluorescent material particles having a surface coated with a coating layer, and the coating layer forming an uneven shape of a surface of the light emitting element.

In order to attain the object, a method for producing a light emitting element in accordance with an embodiment of the present invention is a method for producing a light emitting element for emitting fluorescence upon receiving exciting light emitted from an excitation light source, the method, including the steps of: accumulating a plurality of fluorescent material particles made from a single type of fluorescent material or several types of fluorescent materials on a substrate so as to form a layer of the plurality of fluorescent material particles; and coating each of surfaces of the plurality of fluorescent material particles with a coating layer so as to form an uneven shape of a surface of the light emitting element.

According to the configuration, the plurality of fluorescent material particles made from the single type of fluorescent material or the several types of fluorescent materials are accumulated on the substrate to form a layer of the plurality of fluorescent material particles, and each of the plurality of fluorescent material particles has the surface coated with the coating layer. However, the coating layer does not completely fill gaps between the fluorescent material particles. Therefore, the light emitting element can have the uneven surface. By forming the uneven shape of the surface of the light emitting element by use of the coating layer, it is possible to scatter the exciting light with which the light emitting element is irradiated. This allows coherency of the exciting light to be reduced even in a case where the coherency of the exciting light is high. It is therefore possible to produce a light emitting element excellent in safety.

The coating with the coating layer makes it possible to improve adhesiveness between the fluorescent material particles, or adhesiveness between the fluorescent material particles and the substrate. It is therefore possible to enhance durability of the light emitting element.

Further, the coating with the coating layer increases a contact area between the fluorescent material particles and the substrate, whereby heat of the fluorescent material particles can be efficiently dissipated from the substrate, and therefore thermal conductivity of the light emitting element can be improved. It is therefore possible to prevent increase in temperature of the light emitting element, and attain a long life of the light emitting element.

Advantageous Effects of Invention

As described above, a light emitting element in accordance with an embodiment of the present invention includes a plurality of fluorescent material particles accumulated on a substrate to form a layer of the plurality of fluorescent material particles, each of the plurality of fluorescent material particles has a surface coated with a coating layer, and the coating layer forms an uneven shape of a surface of the light emitting element.

Further, a method for producing a light emitting element in accordance with an embodiment of the present invention is a method including the steps of: accumulating a plurality of fluorescent material particles on a substrate so as to form a layer of the plurality of fluorescent material particles; and coating each of surfaces of the plurality of fluorescent material particles with a coating layer such that the light emitting element has an uneven surface.

Therefore, the light emitting element in accordance with an embodiment of the present invention yields an effect of attaining a long life, and improving its durability and safety. A light emitting element production method of the present invention yields an effect of producing a light emitting element excellent in durability and safety with a long life.

BRIEF DESCRIPTION OF DRAWINGS

FIG. 1 is a cross-sectional view of a light emitting section in accordance with an embodiment of the present invention. FIG. 1(*a*) is a view showing a state in which fluorescent material particles are accumulated on a metal substrate. FIG. 1(*b*) is a view showing (i) a light emitting section in which each of the fluorescent material particles has a surface coated with a coating layer, and (ii) a state where light enters and is emitted from the light emitting section.

FIG. 2 is a cross-sectional view schematically showing a configuration of a headlamp in accordance with an embodiment of the present invention.

FIG. 3 is a view conceptually showing a paraboloid of revolution of a parabolic mirror included in a headlamp in accordance with an embodiment of the present invention.

FIG. 4 is an explanatory view of a shape of the parabolic mirror shown in FIG. 3. FIG. 4(*a*) is a top view of a parabolic mirror 5. FIG. 4(*b*) is an elevation view of the parabolic mirror 5. FIG. 4(*c*) is a side view of the parabolic mirror 5.

FIG. 5 is a view schematically showing an experiment in which a light distribution property of light reflected by a light emitting section is measured.

FIG. 6(*a*) is a view showing the light distribution property of the reflected light measured in the experiment of FIG. 5. FIG. 6(*b*) is an enlarged view of FIG. 6(*a*).

FIG. 7 is a flowchart of a process for producing a light emitting section in accordance with an embodiment of the present invention.

FIG. 8 is a picture showing an image (SEM image) of a surface of a light emitting section, which surface is observed by use of an SEM (scanning electron microscope). FIG. 8(*a*) is an SEM image of a surface of a light emitting section, which surface is not coated with a coating layer. FIG. 8(*b*) is an SEM image obtained by partially enlarging the SEM image of FIG. 8(*a*). FIG. 8(*c*) is an SEM image of a surface of a light emitting section, which surface is coated with a coating layer. FIG. 8(*d*) is an SEM image obtained by partially enlarging the SEM image of FIG. 8(*c*).

FIG. 9 is a view conceptually showing a direction in which a headlamp in accordance with an embodiment of the present invention is attached as an automotive (vehicular) headlamp.

FIG. 10 is a view schematically showing a headlamp in accordance with an embodiment of the present invention.

DESCRIPTION OF EMBODIMENTS

The following description will discuss an embodiment of the present invention with reference to FIGS. 1 through 10.

A light emitting element in accordance with an embodiment of the present invention is configured such that each of fluorescent material particles accumulated on a substrate has a surface coated with a coating layer having an uneven shape. This configuration makes it possible to scatter exciting light with which the light emitting element is irradiated, and reduce coherency of the exciting light in a case where a fluorescent material is excited by the exciting light.

<Configuration of Headlamp 1>

Figure 2:
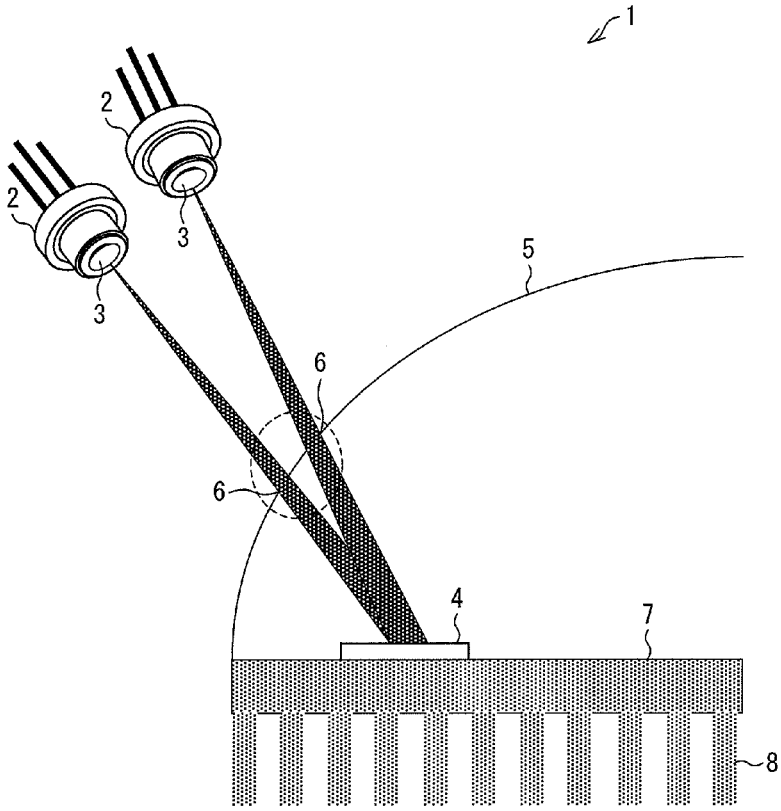
FIG. 2

FIG. 2 is a cross-sectional view schematically illustrating a configuration of a headlamp 1 in accordance with an embodiment of the present invention. As shown in FIG. 2, the headlamp 1 includes a laser element (excitation light source, semiconductor laser) 2, a lens 3, a light emitting section 4 (light emitting element), a parabolic mirror (reflecting mirror) 5, a metallic base 7, and fins 8.

(Laser Element 2)

The laser element 2 is a light emitting element functioning as an excitation light source for emitting exciting light. The number of laser elements 2 may be more than one. In the case where a plurality of laser elements 2 are provided, each of the laser elements 2 emits a laser beam serving as exciting light. Instead of the plurality of laser elements 2, only one laser element 2 may be provided. However, a high-power laser beam can be more easily attained with a plurality of laser elements 2 than with only one laser element 2.

The laser element 2 may be a single chip having a single light emitting point, or a single chip having a plurality of light emitting points. The laser element 2 emits a laser beam having a wavelength of, e.g., 405 nm (blue-violet) or 450 nm (blue). However, the wavelength of the laser beam is not limited to these, and can be determined appropriately in accordance with a type of a fluorescent material contained in the light emitting section 4.

(Lens 3)

The lens 3 is a lens for adjusting (e.g., magnifying) an emission range of the laser beam in order that the laser beam from the laser element 2 is appropriately incident on the light emitting section 4. The lens 3 is provided for each of the laser elements 2.

(Light Emitting Section 4)

The light emitting section 4 emits fluorescence upon receiving the laser beam emitted from the laser element 2. The light emitting section 4 includes a fluorescent material for emitting light upon receiving the laser beam. Because the light emitting section 4 converts a laser beam into fluorescence, the light emitting section 4 can be called a wavelength conversion device.

Figure 1:
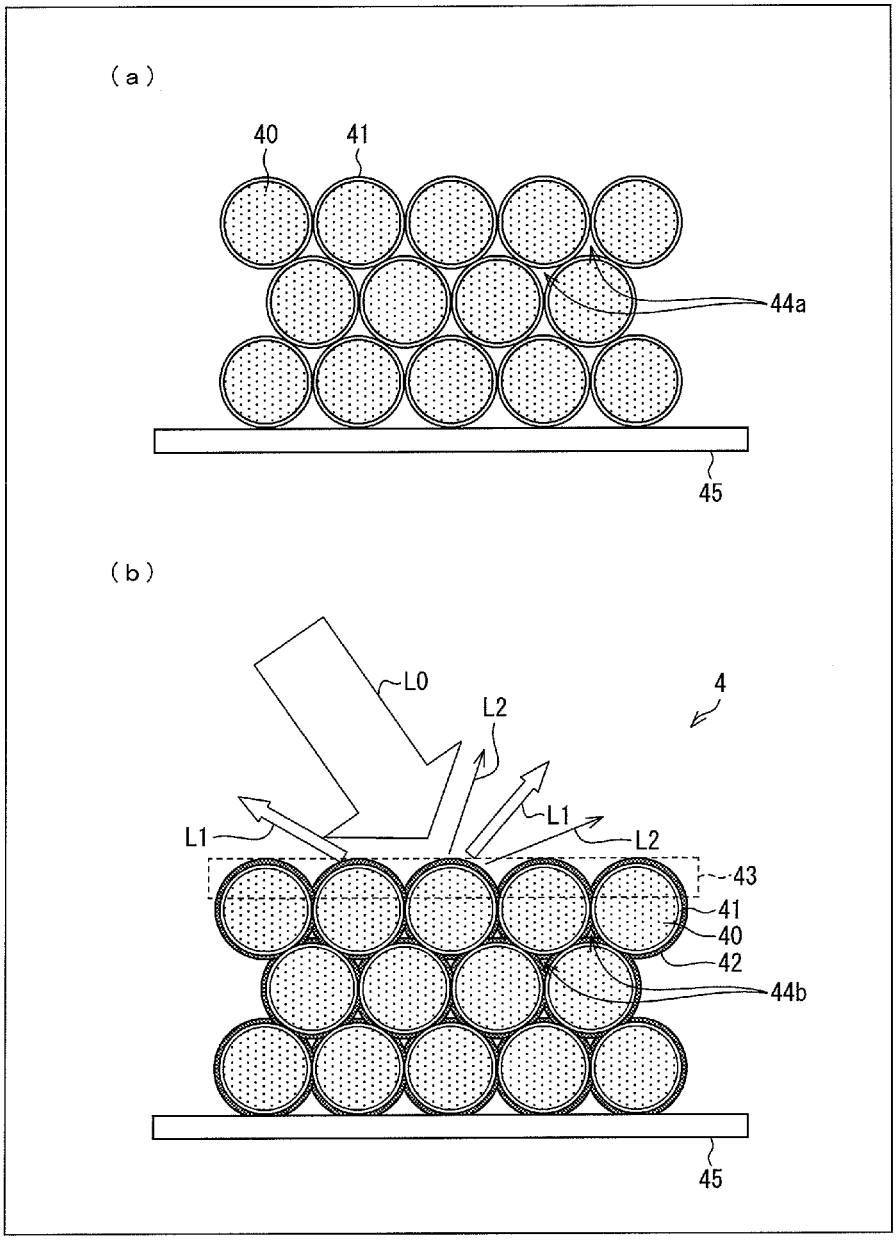
FIG. 1
Figure 5:
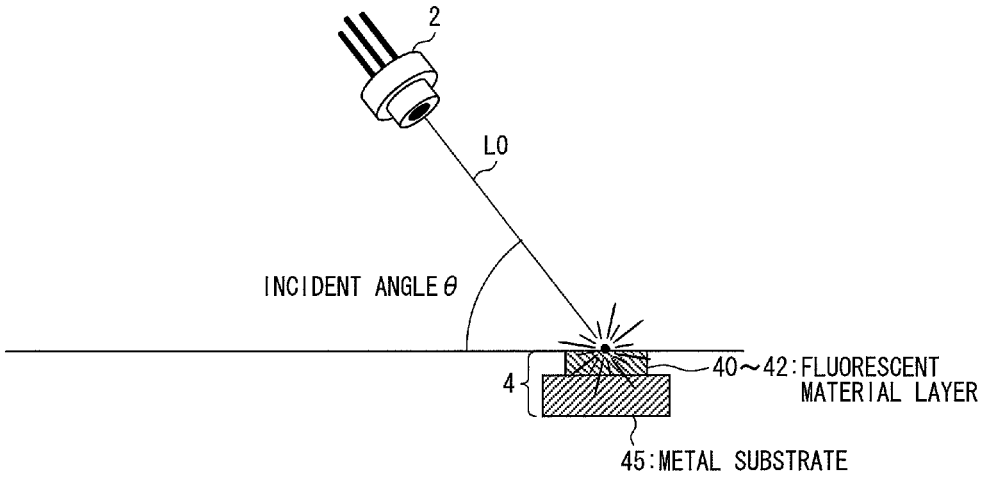
FIG. 5

Specifically, the light emitting section 4 includes a plurality of fluorescent material particles 40 accumulated on a substrate (metal substrate 45) to form a layer of the plurality of fluorescent material particles 40, as shown in FIG. 1(*b*) or FIG. 5. Each of the plurality of fluorescent material particles 40 has a surface covered with (i) a binder 41 that contains, for example, TEOS (tetra ethoxy silane, ethyl silicate), and (ii) a coating layer 42 made from an inorganic substance such as $TiO_2$ in this order. The coating layer 42 forms an uneven shape 43 of a surface of the light emitting section 4. Note that a concrete configuration of the light emitting section 4, and a method for producing the light emitting section 4 are described later.

The light emitting section 4 is provided on the metallic base 7 and substantially at a focal point of the parabolic mirror 5. Therefore, fluorescence emitted from the light emitting section 4, and scattered light scattered on the surface of the light emitting section 4 are reflected by a reflecting curved surface of the parabolic mirror 5, so that an optical path of light reflected by the reflecting curved surface is controlled.

Examples of the fluorescent material particles 40 of the light emitting section 4 encompass an oxynitride fluorescent material (e.g., a sialon fluorescent material) and a III-V compound semiconductor nanoparticle fluorescent material (e.g., indium phosphide: InP). These fluorescent materials are high in heat resistance against a high-power (and/or high-light density) laser beam emitted from the laser element 2, and therefore are suitably used in a laser illumination light source. Note, however, that the fluorescent material of the light emitting section 4 is not limited to those described above, and other fluorescent materials, such as a nitride fluorescent material, can be employed.

Further, under the Japanese law, a color of illumination light of a headlamp is limited to white having chromaticity in a predetermined range. For this reason, the light emitting section 4 includes a fluorescent material(s) with which white illumination light is obtained.

For example, white light can be generated by emitting a laser beam of 405 nm onto a light emitting section 4 containing a blue fluorescent material, a green fluorescent material, and a red fluorescent material. Alternatively, white light can be generated by emitting a laser beam of 450 nm (blue) (or a so-called blue-like laser beam having a peak wavelength in a range of 440 nm or more but not more than 490 nm) onto a light emitting section 4 containing a yellow fluorescent material (or a green fluorescent material and a red fluorescent material). As described above, the light emitting element 4 includes the plurality of fluorescent material particles 40 made from several types of fluorescent materials.

Note that the fluorescent material particles 40 included in the light emitting section 4 can be made from one type of fluorescent material provided that (i) the white light can be obtained or (ii) a light emitting device of the present embodiment is a light emitting device that does not need to emit the white light.

(Parabolic Mirror 5)

The parabolic mirror 5 reflects the fluorescence and the scattered light generated by the light emitting section 4 so as to form a pencil of beams (illumination light) that travels in a predetermined solid angle. The parabolic mirror 5 may be, e.g., (i) a member whose surface is coated with a metal thin film or (ii) a metallic member.

Figure 3:
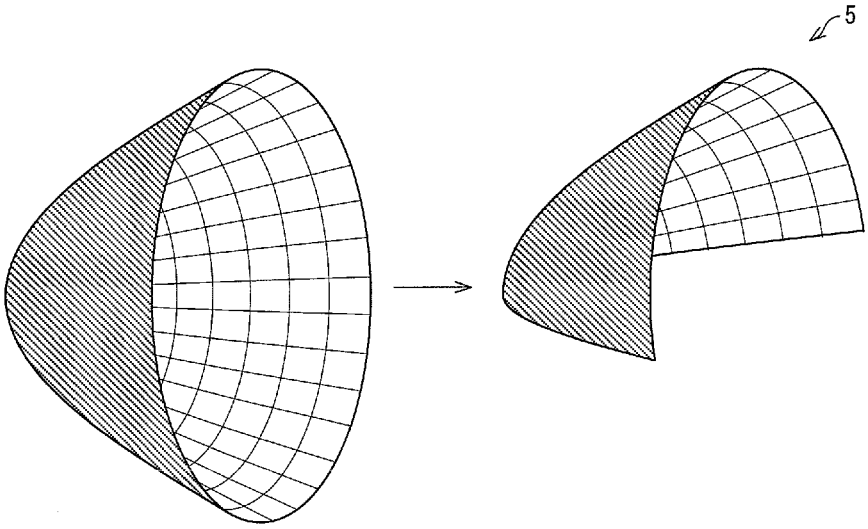
FIG. 3
Figure 4:
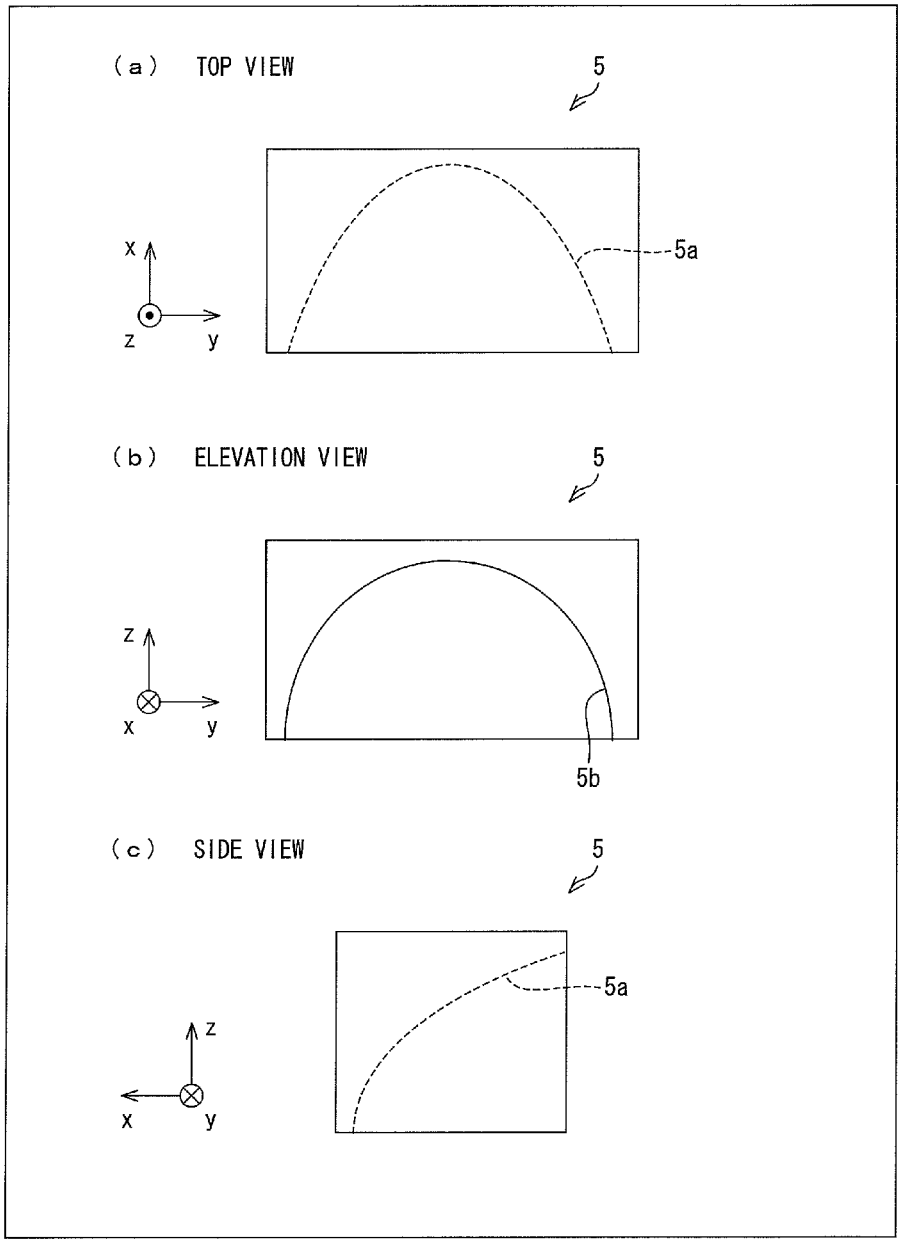
FIG. 4

FIG. 3 is a view conceptually illustrating a paraboloid of revolution of the parabolic mirror 5. FIG. 4(*a*) is a top view of the parabolic mirror 5. FIG. 4(*b*) is an elevation view of the parabolic mirror 5. FIG. 4(*c*) is a side view of the parabolic mirror 5. For simple explanation, each of FIG. 4(*a*) through FIG. 4(*c*) shows an example where the parabolic mirror 5 is formed by hollowing out an inside of a rectangular solid member.

As shown in FIG. 3, the parabolic mirror 5 includes, as its reflecting surface, at least a part of a partial curved surface obtained by (i) forming a curved surface (parabolic curved surface) by rotating a parabola around a rotational axis which is a symmetric axis of the parabola, and by (ii) cutting the curved surface along a plane including the rotational axis. The parabolic curved surface is shown as a curved line indicated by a reference sign 5*a* in each of FIG. 4(*a*) and FIG. 4(*c*). Further, as shown in FIG. 4(*b*), an opening 5*b* (an exit through which illumination light exits) of the parabolic mirror 5 is shaped in a half circle when the parabolic mirror 5 is viewed from the front.

A part of the parabolic mirror 5 having such a shape is provided above an upper surface of the light emitting section 4, which upper surface has a larger area than that of a side surface of the light emitting section 4. That is, the parabolic mirror 5 is provided so as to cover the upper surface of the light emitting section 4. From another point of view, a part of the side surface of the light emitting section 4 faces the opening 5*b* of the parabolic mirror 5.

With the above positional relationship between the light emitting section 4 and the parabolic mirror 5, it is possible to efficiently project, into a narrow solid angle, the fluorescence and the scattered light generated by the light emitting section 4. As a result, it is possible to increase use efficiency of the fluorescence and the scattered light.

The laser element 2 is provided outside of the parabolic mirror 5, and the parabolic mirror 5 is provided with a window section 6 through which a laser beam is transmitted or passed. The window section 6 can be an opening or a section including a transparent member which can transmit a laser beam. For example, the window section 6 may be a transparent plate provided with a filter which transmits a laser beam but reflects white light (the fluorescence and the scattered light generated by the light emitting section 4). With this configuration, it is possible to prevent the fluorescence and the scattered light generated by the light emitting section 4 from leaking from the window section 6.

The number of window sections 6 is not particularly limited. A single window section 6 can be shared by the plurality of laser elements 2. Alternatively, a plurality of window sections 6 can be provided for the plurality of laser elements 2, respectively.

Note that a part of the parabolic mirror 5 may not be a part of the parabola. Further, the reflecting mirror of the light emitting device of the present invention can be (i) a parabolic mirror having an opening shaped in a closed ring or (ii) the one including a part of such a parabolic mirror. Furthermore, the reflecting mirror is not limited to the parabolic mirror, but may be a mirror having an elliptic surface or a mirror having a hemispheric surface. That is, the reflecting mirror can be any mirror provided that it includes, as its reflecting surface, at least a part of a curved surface formed by rotating a figure (ellipse, circle, parabola) around a rotational axis.

(Metallic Base 7)

The metallic base 7 is a plate-shaped supporting member for supporting the light emitting section 4, and is made from a metal (e.g., copper or iron). Accordingly, the metallic base 7 has high heat conductivity, and can efficiently dissipate heat generated by the light emitting section 4. Note that the member for supporting the light emitting section 4 is not limited to a member made from a metal, but may be a member other than a metal, which member contains a material (glass, sapphire, etc.) having high heat conductivity.

The metallic base 7 is covered with the parabolic mirror 5. That is, the metallic base 7 has a surface facing the reflecting curved surface (parabolic curved surface) of the parabolic mirror 5. Preferably, the surface of the metallic base 7, on which surface the light emitting section 4 is provided, is substantially parallel to the rotational axis of the paraboloid of revolution of the parabolic mirror 5, and substantially includes the rotational axis.

(Fins 8)

The fins 8 function as a cooling section (heat dissipation mechanism) for cooling the metallic base 7. The fins 8 are configured as a plurality of heat dissipating plates, so that the fins 8 have an increased contact area with the atmosphere. This allows the fins 8 to have improved heat dissipation efficiency. The cooling section for cooling the metallic base 7 only needs to have a cooling (heat dissipation) function. The cooling section may employ a heat pipe, a water-cooling system, or an air-cooling system.

<Concrete Configuration of Light Emitting Section 4, and Method for Producing Light Emitting Section 4>

(Concrete Configuration of Light Emitting Section 4)

The following description will discuss a concrete configuration of the light emitting section 4, and a method for producing the light emitting section 4, with reference to FIG. 1, and FIGS. 5 through 8. First, the concrete configuration of the light emitting section 4 is described with reference to FIG. 1. FIG. 1 is a cross-sectional view of the light emitting section 4. FIG. 1(*a*) is a view showing a state in which the fluorescent material particles 40 are accumulated on the metal substrate 45. FIG. 1(*b*) is a view showing (i) the light emitting section 4 in which each of the fluorescent material particles 40 has a surface coated with a coating layer, and (ii) a state where light enters and is emitted from the light emitting section 40.

As shown in FIG. 1(*b*), the light emitting section 4 includes (i) the fluorescent material particles 40 each of which is covered with the binder 41 and the coating layer 42, and (ii) the metal substrate 45. Note that the function of the light emitting section 4, and the fluorescent material particles 40 are already described above, and therefore, descriptions thereof are omitted here.

The binder 41 is used for bonding, to each other, the fluorescent material particles 40 accumulated on the metal substrate 45 by means of electrophoresis to form a layer of the fluorescent material particles 40. The binder 41 is made by, for example, adding, to ethanol, TEOS or TEMOS (tetra methoxy silane), water, and acid (for example, concentrated hydrochloric acid) to generate hydrolysis. The resultant is dried and burned to finally become silica. FIG. 1(*a*) illustrates a state where each of the fluorescent material particles 40 has a surface covered with the binder 41. The covering of the surface of each of the fluorescent material particles 40 with the binder 41 makes it possible to accumulate the fluorescent material particles 40 on the metal substrate 45 by means of, for example, electrophoresis so as to form a layer of the fluorescent material particles 40.

The coating layer 42 further strongly adheres the fluorescent material particles 40 to each other, and also further strongly adheres the fluorescent material particles 40 to the metal substrate 45. The surface of each of the fluorescent material particles 40 is coated with the coating layer 42. The coating layer 42 is made from, for example, an inorganic material (inorganic coating material) such as $TiO_2$ or $SiO_2$.

The binder 41 is required when the fluorescent material particles 40 are accumulated on the metal substrate 45 by means of electrophoresis. However, the binder 41 does not so tightly adhere the fluorescent material particles 40 to each other. This is because the fluorescent material particles 40 thus accumulated form gaps 44*a* therebetween, as shown in FIG. 1(*a*). According to the present embodiment, the fluorescent material particles 40 whose surfaces are covered with the binder 41 are further coated with the coating layer 42. That is, the surfaces of the fluorescent material particles 40 are coated with the coating layer 42 via the binder 41. This reduces the gaps 44*a* in size to gaps 44*b*, as shown in FIG. 1(*b*). It is therefore possible to improve adhesiveness between the fluorescent material particles 40, and adhesiveness between the fluorescent material particles 40 and the metal substrate 45. Note that the binder 41 is not necessarily required in a case where the fluorescent material particles 40 are accumulated by, for example, a sedimentation method, instead of electrophoresis. In this case, the surfaces of the fluorescent material particles 40 are directly coated with the coating layer 42.

Increase in thickness of the coating layer 42 reduces the gaps 44*b* in size. However, too much increase in thickness of the coating layer 42 eliminates the gaps 44*b*. Such increase in thickness of the coating layer 42 that eliminates the gaps 44*b* may eliminate unevenness of the surfaces of the fluorescent material particles 40 (a surface of the light emitting section 4 which surface is opposite to another surface of the light emitting section 4 which another surface is in contact with the metal substrate 45) accumulated to form a layer of the fluorescent material particles 40, thereby probably flattening the surface of the light emitting section 4. In this case, the adhesiveness between the fluorescent material particles 40, the adhesiveness between the fluorescent material particles 40 and the metal substrate 45, thermal conductivity, and the like can be improved. However, a laser beam L0 is reflected by the surface thus flattened as it is when the surface thus flattened is irradiated with the laser beam L0, in a case of FIG. 1(*b*). That is, in a case where the surfaces of the fluorescent material particles 40 thus accumulated are coated with an inorganic material or the like so that the gaps 44*b* between the fluorescent material particles 40 are completely filled with the inorganic material or the like, the surface of the light emitting section 4 is completely covered with the inorganic material or the like. Consequently, the laser beam L0 having a high coherency is possibly reflected by the surface of the light emitting section 4 as it is when the surface of the light emitting section 4 is irradiated with the laser beam L0.

In a case where the laser beam L0 keeping a high coherency is emitted as illumination light outside of the headlamp 1, human eyes are highly likely to be damaged by the illumination light. Therefore, a light emitting device that employs the laser beam L0 as exciting light should (i) convert, into fluorescence, the laser beam L0 with which the light emitting section 4 is irradiated or (ii) scatter the later beam L0, so as to emit the laser beam L0 as incoherent illumination light that is unlikely to damage human eyes.

According to the present embodiment, the surfaces of the fluorescent material particles 40 are coated with the coating layer 42 in such a manner that the gaps 44*b* are present (in such a manner that the gaps 44*b* are not eliminated). This can improve the adhesiveness between the fluorescent material particles 40, and the adhesiveness between the fluorescent material particles 40 and the metal substrate 45. This also allows the fluorescent material particles 40 and the coating layer 42 to form the uneven shape 43 on the surface of the light emitting section 4. It is therefore possible to scatter the laser beam L0 and reduce the coherency of the laser beam L0.

In contrast, in a case where the surface of the light emitting section is sufficiently flat, the laser beam is subjected to specular reflection. Therefore, an emission pattern has a great angular dependency. However, according to the present embodiment, the uneven shape 43 is formed on the surface of the light emitting section 4. In this case, the laser beam that enters the surface of the light emitting section 4 is reflected in various directions. Therefore, a divergent angle of the laser beam is increased, and the angular dependency of the emission pattern is reduced. Consequently, according to the present embodiment, it is possible to obtain scattered light having a low coherency (incoherent illumination light) on the surface of the light emitting section 4 from incident light (laser beam) having a high coherency.

Distribution of laser beams with which a fluorescent material is irradiated and which are reflected without being converted into fluorescence depends on an incident angle of the laser beams to the light emitting section 4. The following description will discuss a relationship between the incident angle and a light distribution property of reflected light, with reference to FIGS. 5 and 6. FIG. 5 is a view schematically showing an experiment in which a light distribution property of light reflected by the light emitting section 4 is measured. In FIG. 5, a fluorescent material layer is irradiated with the laser beam L0, in which fluorescent material layer the fluorescent material particles 40 are accumulated on the metal substrate 45 by means of electrophoresis, and the fluorescent material particles 40 (covered with the binder 41) are coated with the coating layer 42 made from $TiO_2$. In FIG. 5, the fluorescent material is a β-SiAlON:Eu fluorescent material whose particle diameter ranges from 1 μm to 10 μm. The whole fluorescent material layer including the binder 41 and the coating layer 42 has a thickness of 130 μm. The laser element 2 has an output of 50 mW.

Further, in FIG. 5, the laser element 2 is configured such that an incident angle θ can be changed. In this example, the laser element 2 can change its location such that the incident angle θ is 4°, 14°, 32°, 46°, or 58°. The incident angle is not limited to the five angles, but can be changed according to a measurement condition.

Figure 6:
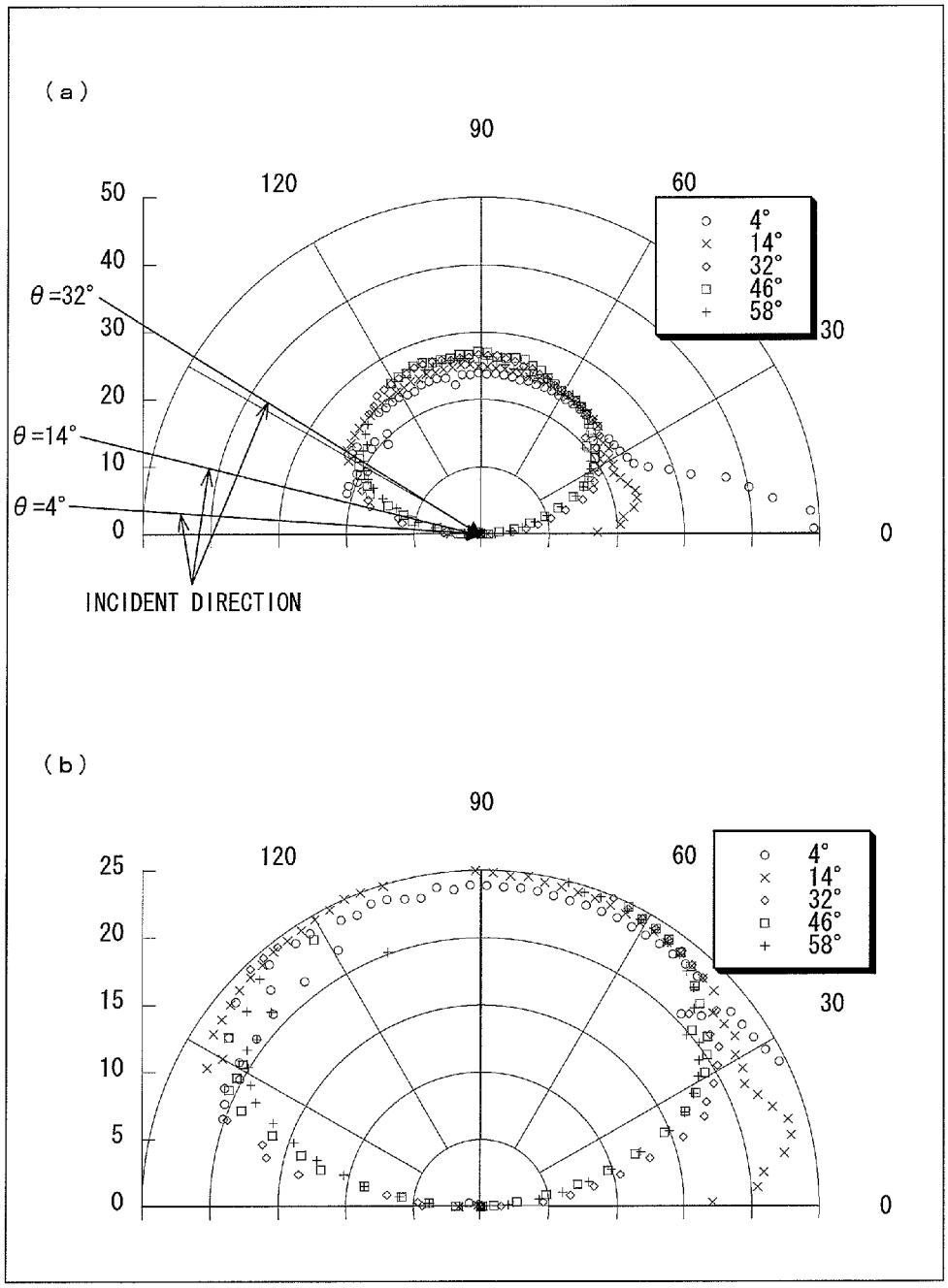
FIG. 6

FIG. 6 is an explanatory view of a light distribution property of light reflected by the light emitting section 4. FIG. 6(*a*) is a view showing an incident angle θ of the laser beam in the experiment shown in FIG. 5, and a light distribution property of reflected light. FIG. 6(*b*) is an enlarged view of FIG. 6(*a*). FIG. 6 shows light distribution properties of reflected light for the respective incident angles of 4°, 14°, 32°, 46°, and 58°.

FIGS. 6(*a*) and 6(*b*) show the light distribution properties of reflected light for the respective incident angles θ under a condition such as the output.

As is clear from the FIG. 6, in a case where the incident angle θ is 4° or 14° (in a case where the incident angle θ is low), reflected light is dependent on the incident angle θ. In this case, the reflected light dependent on the incident angle, which reflected light is present within a distribution, substantially becomes light specularly reflected by a uniform plain surface. Therefore, the reflected light present within the distribution is unlikely to be converted into scattered light having a low coherency even by the uneven shape 43.

Meanwhile, in a case where the incident angle θ is not less than 32° (46° or 58°), the light distribution properties of the incident angles θ are substantially identical to one another, and reflected light is not dependent on the incident angles θ. In this case, most of the reflected light does not substantially become specularly reflected light, unlike the case where the incident angle θ is low. This can be said that the uneven shape 43 makes it possible to obtain safer scattered light having a low coherency from incident light having a high coherency.

It is therefore preferable that the laser beam L0 enters at an incident angle θ of not less than 32°, so that the scattered light having a low coherency is obtained from the incident light having a high coherency under the condition. Note that this is an example, and a value of the incident angle θ suitable for obtaining the scattered light having a low coherency can be changed as appropriate in accordance with a particle diameter of the fluorescent material particles 40, and/or a thickness of the coating layer 42 that are included in the light emitting section 4 to be produced.

As described above, according to the present embodiment, the coating layer 42 forms the uneven shape 43 of the surface of the light emitting section 4. This makes it possible to produce the light emitting section 4 capable of not only enhancing the adhesiveness between the fluorescent material particles 40, the adhesiveness between the fluorescent material particles 40 and the metal substrate 45 so as to improve durability but also reducing the coherency of the laser beam so as to improve safety.

In a case where the uneven shape 43 of the surface of the light emitting section 4 has an arithmetic average roughness of not less than 0.5 μm, and a maximum height of not less than 1 μm, it is possible to obtain sufficiently incoherent scattered light from exciting light having a high coherency, which exciting light enters the surface of the light emitting section 4. Further, in this case, it is also possible to produce the light emitting section 4 excellent in safety.

Generally, a fluorescent material particle has a diameter (median size) which falls within a range from 5 μm to 40 μm. The diameter of the fluorescent material particle is widely distributed. Therefore, in a case where the thickness of the coating layer 42 is set to not more than 30% of the particle diameter of the fluorescent material particles 40, the uneven shape 43 of the surface of the light emitting section 4 has an arithmetic average roughness (Ra) of not less than 0.5 μm, and a maximum height (Ry) of 1 μm. This allows the light emitting section 4 to emit the sufficiently incoherent scattered light upon receiving the incident light having a high coherency.

The metal substrate 45 is a substrate on which the fluorescent material particulates 40 are to be accumulated to form a layer of the fluorescent material particles 40. The metal substrate 45 has a thickness of, for example, 1 mm. It is preferable that the metal substrate 45 function as a reflection surface. In this case, the laser beam that enters through an upper surface of the light emitting section 4 is converted into fluorescence, and then can be reflected by the reflection surface. Alternatively, the laser beam that enters through the upper surface of the light emitting section 4 is reflected by the reflection surface, and then can be caused to travel through the light emitting section 4 again to be converted into fluorescence. The metal substrate 45 also functions as a heat spreader for releasing, from the metallic base 7 to the fins 8, heat generated by the laser beam L0 with which the light emitting section 4 is irradiated. The metal substrate 45 can also function as an electrode in a case where the fluorescent material particles 40 are accumulated on the metal substrate 45 by means of electrophoresis, because the metal substrate 45 has electrical conductively.

As described above, the light emitting section 4 is configured such that the plurality of fluorescent material particles 40 are accumulated on the metal substrate 45, and each of the plurality of fluorescent material particles 40 thus accumulated has a surface coated with the coating layer 42. Adjustment of the thickness of the coating layer 42 allows the light emitting section 4 to have the uneven shape 43 on its surface.

As shown in FIG. 1(*b*), the laser beam L0 with which the light emitting section 4 is irradiated is partially converted into fluorescence L2 in the fluorescent material particles 40, while the other of the laser beam L0 is scattered by the uneven shape 43 formed on the surface of the light emitting section 4, so as to be emitted as scattered light L1. That is, the uneven shape 43 prevents the laser beam L0 from being reflected by the surface of the light emitting section 4 (in other words, prevents the laser beam L0 from being emitted as reflected light). The uneven shape 43 allows the laser beam L0 to be emitted as the scattered light L1. According to the present embodiment, sufficient unevenness of the surface of the light emitting section 4 allows illumination light including the scattered light L1 and the fluorescence L2 to become incoherent light that does not damage human bodies. It is therefore possible to produce the light emitting section 4 excellent in safety.

That is, according to the present embodiment, even in a case where the laser beam L0 has a high coherency, the coherency of the laser beam L0 can be reduced. It is therefore possible to produce the light emitting section 4 excellent in safety. Further, the coating layer 42 makes it possible to improve the adhesiveness between the fluorescent material particles 40, the adhesiveness between the fluorescent material particles 40 and the metal substrate 45, and thermal conductivity of the light emitting section 4. The improving of the adhesiveness between the fluorescent material particles 40, and the adhesiveness between the fluorescent material particles 40 and the metal substrate 45 can enhance durability of the light emitting section 4. The improving of the thermal conductivity can prevent increase in temperature of the light emitting section 4, thereby attaining a long life of the light emitting section 4.

Hence, the headlamp 1 including the light emitting section 4 of the present embodiment can yield an effect identical to that yielded by the light emitting section 4. That is, the headlamp 1 not only can attain a long life but can also improve its durability and safety.

(Method for Producing Light Emitting Section 4)

Figure 7:
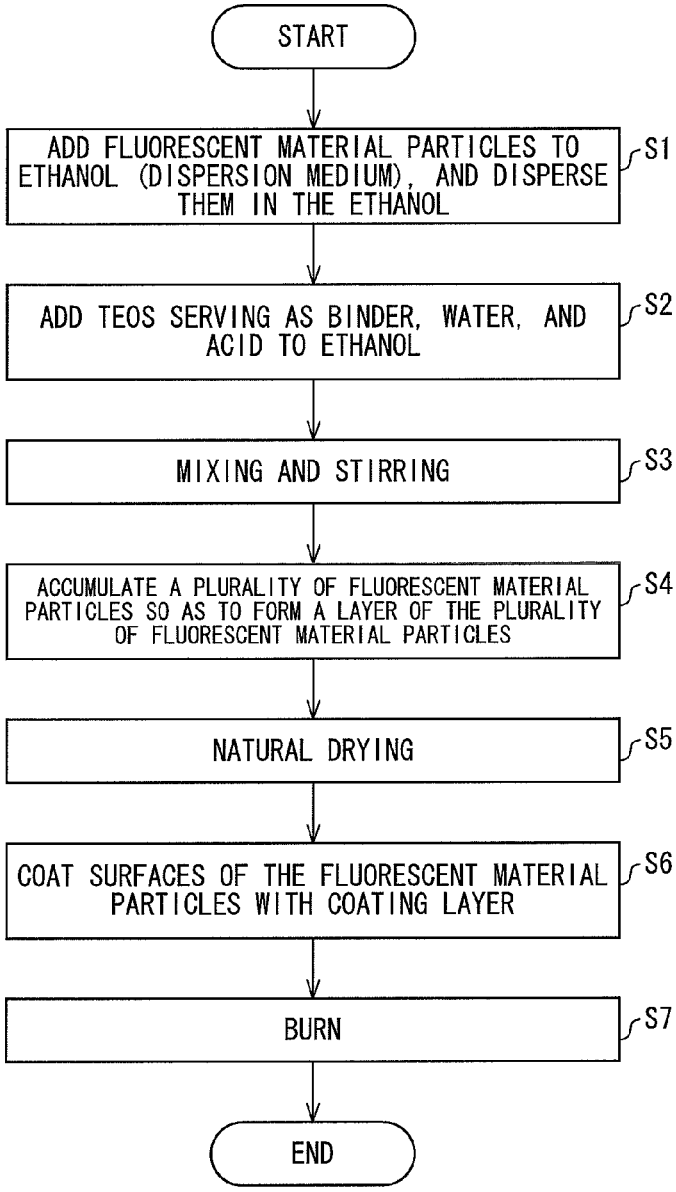
FIG. 7
Figure 8:
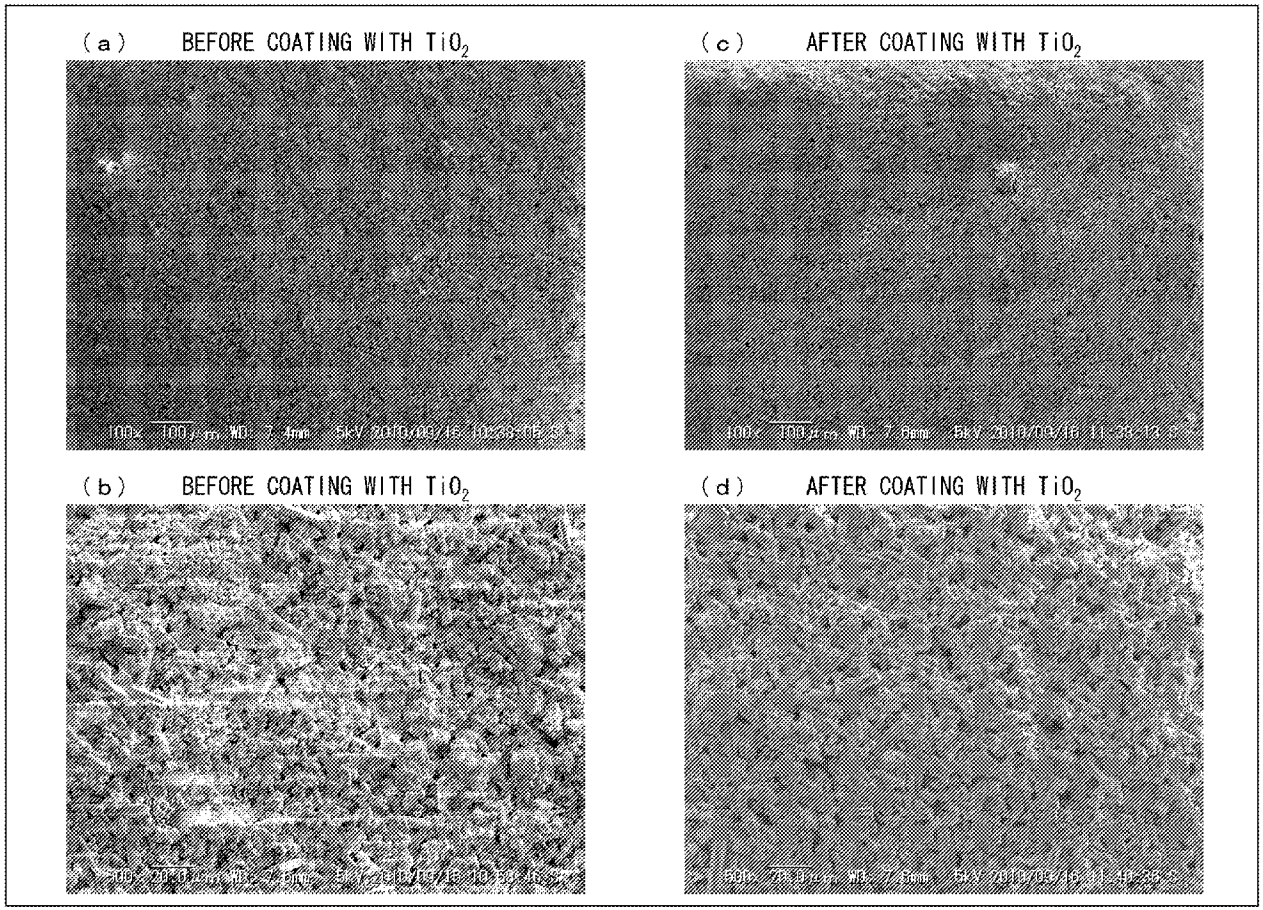
FIG. 8

The following description will discuss a method (process) for producing the light emitting section 4, with reference to FIGS. 7 and 8. FIG. 7 is a flowchart of the process for producing the light emitting section 4. FIG. 8 is a picture showing an image (SEM image) of a surface of a light emitting section, which surface is observed by use of an SEM (scanning electron microscope). FIG. 8(*a*) is an SEM image of a surface of a light emitting section, which surface is not coated with the coating layer 42. FIG. 8(*b*) is an SEM image obtained by partially enlarging the SEM image of FIG. 8(*a*). FIG. 8(*c*) is an SEM image of a surface of a light emitting section, which surface is coated with the coating layer 42. FIG. 8(*d*) is an SEM image obtained by partially enlarging the SEM image of FIG. 8(*c*).

As shown in FIG. 7, in order to adhere binder 41 to fluorescent material particles 40, firstly, the fluorescent material particles 40 are dispersed in ethanol (dispersion medium), so that a dispersion liquid solution thereof is prepared (S1). The dispersing is carried out by use of, for example, an ultrasonic homogenizer. Meanwhile, TEOS, water, and acid are added into ethanol to generate hydrolysis. By the hydrolysis, a liquid solution containing a precursor of silica is produced (S2). An order in which S1 and S2 are carried out is not limited to a specific order provided that S1 and S2 have been carried out before S3 (S1 and S2 can be simultaneously carried out).

Subsequently, the dispersion liquid solution produced by S1 and the liquid solution produced by S2 are mixed and stirred by use of, for example, a stirrer (S3). This allows the binder 41 to be uniformly adhered to each of surfaces of the fluorescent material particles 40.

Subsequently, the fluorescent material particles 40 included in a resultant liquid solution produced by S3 are accumulated on a metal substrate 45 by means of electrophoresis (S4). FIG. 1(*a*) shows a state where the fluorescent material particles 40 are accumulated on the metal substrate 45. Utilization of the electrophoresis makes it possible to uniformly accumulate, with a substantially constant thin thickness, the plurality of fluorescent material particles 40 over a surface of the metal substrate 45. Meanwhile, in a case where fluorescent material particles are sealed on a glass, a transparent substrate or the like by use of, for example, a sealing material so that a light emitting section is produced, an emission efficiency can be reduced by heat generated in the sealing material during excitation. However, any sealing materials are not used in the electrophoresis. Therefore, the emission efficiency cannot be reduced.

Note that, in S4, the fluorescent material particles 40 are accumulated on the metal substrate 45 by means of electrophoresis. However, the method for accumulating the fluorescent material particles 40 on the metal substrate 45 is not limited to the electrophoresis. Alternatively, the fluorescent material particles 40 can be accumulated by a sedimentation method. In a case where the sedimentation method is employed, the fluorescent material particles 40 are accumulated on the metal substrate 45 due to their weight. Therefore, a voltage needs not to be applied, unlike the electrophoresis. Further, a step for preparing the binder 41 (S2) is not necessarily required.

Subsequently, the metal substrate 45 on which the fluorescent material particles 40 are accumulated is naturally dried (S5), and then each of the surfaces of the fluorescent material particles 40 is coated with the coating layer 42 by a spin coat method (S6). The spin coat method is carried out by applying an inorganic material such as $TiO_2$ onto the surfaces of the fluorescent material particles 40. Note that, since the surfaces of the fluorescent material particles 40 are covered with the binder 41 in the case where electrophoresis is employed, the surfaces of the fluorescent material particles 40 are coated with the coating layer 42 via the binder 41. Note also that, in a case where the binder 41 is removed from the fluorescent material particles 40 accumulated by means of electrophoresis, the fluorescent material particles 40 are directly coated with the coating layer 42. Subsequently, the fluorescent material particles 40 coated with the coating layer 42 are burned by use of, for example, an oven, so that the light emitting section 4 is produced (S7). FIG. 1(*b*) shows a state where the fluorescent material particles 40 accumulated on the metal substrate 45 are covered with the coating layer 42.

FIG. 8 shows an image of a surface of a fluorescent material film made up of the plurality of fluorescent material particles 40 obtained after S5, and an image of a surface of a fluorescent material film made up of the plurality of fluorescent material particles 40 obtained after S7. The images of FIG. 8 are obtained when the surfaces are observed by use of an SEM.

The fluorescent material film obtained after S5 includes the fluorescent material particles 40 whose surfaces are covered with the binder 41. FIGS. 8(*a*) and 8(*b*) show SEM images of the surface of the fluorescent material film. Meanwhile, the fluorescent material film obtained after S7 includes the fluorescent material particles 40 whose surfaces are coated with the coating layer 42 via the binder 41. FIGS. 8(*c*) and 8(*d*) show SEM images of the surface of the fluorescent material film. Note that the SEM images of FIGS. 8(*a*) and FIG. 8(*c*) are shot at an identical lens magnification, and the SEM images of FIGS. 8(*b*) and 8(*d*) are shot at an identical lens magnification that is higher than that at which the SEM images of FIGS. 8(*a*) and 8(*c*) are shot.

The fluorescent material of FIG. 8 is a β-SiAlON:Eu fluorescent material. The whole fluorescent material film including the binder 41, shown in FIGS. 8(*a*) and 8(*b*), has a thickness of approximately 90 μm. The whole fluorescent material film including the binder 41 and the coating layer 42, shown in FIGS. 8(*c*) and 8(*d*), has a thickness of approximately 80 μm. The fluorescent material particles 40 are burned at 200° C. for 5 minutes.

The surface of the fluorescent material film of the SEM images of FIGS. 8(*c*) and 8(*d*) is more uniform than that of the fluorescent material film of the SEM images of FIGS. 8(*a*) and 8(*b*). Meanwhile, the fluorescent material film of the SEM images of FIGS. 8(*c*) and 8(*d*) still has gaps. Therefore, the surface of the fluorescent material film of the SEM images of FIGS. 8(*c*) and 8(*d*) still have an uneven shape thereon. That is, the fluorescent material particles 40 whose surfaces are coated with the coating layer 42 have the adhesiveness between the fluorescent material particles 40, and the adhesiveness between the fluorescent material particles 40 and the metal substrate 45, and the thermal conductivity, which are greater than those of the fluorescent material particles 40 whose surfaces are not coated with the coating layer 42. Further, since the surface of the fluorescent material film of the SEM images of FIGS. 8(*c*) and 8(*d*) still have an uneven shape thereon even in a case where the surfaces of the fluorescent material particles 40 are coated with the coating layer 42, coherency of a laser beam with which the surfaces of the fluorescent materials 40 are irradiated can be eliminated.

The method for producing the light emitting section 4 includes a step (S4) for accumulating, on the metal substrate 45, a plurality of fluorescent material particles 40 made from a single type of fluorescent material or several types of fluorescent materials so as to form a layer of the plurality of fluorescent material particles 40, and a step (S6) for coating each of surfaces of the plurality of fluorescent material particles 40 with the coating layer 42. Specifically, in S6, the surface of the light emitting section 4 is coated with the coating layer 42 so as to have the uneven shape 43, as is clear from FIGS. 8(*c*) and 8(*d*). Execution of these steps makes it possible to produce the light emitting section 4 excellent in durability and safety with a long life.

<Attaching of Headlamp 1>

Figure 9:
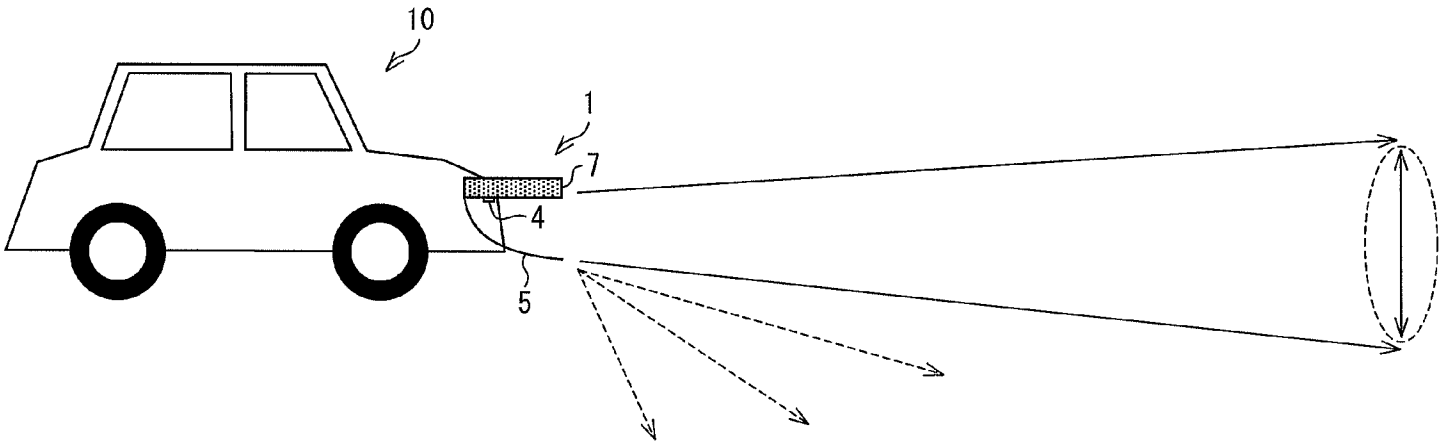
FIG. 9

FIG. 9 is a view conceptually illustrating a direction in which the headlamp 1 is attached as a headlamp (vehicular headlamp) of an automobile (vehicle) 10. As shown in FIG. 9, the headlamp 1 can be attached to a head of the automobile 10 such that the parabolic mirror 5 is provided in a lower side of a vertical direction. By attaching the headlamp 1 to the head of the automobile 10 in this manner, the automobile 10 can emit light having sufficient brightness in its front direction, and also can emit light in its forward-downward direction, thanks to the above-described light projection property of the parabolic mirror 5.

The headlamp 1 of the present embodiment is provided in the automobile 10. Therefore, the automobile 10 can yield an effect identical to that yielded by the headlamp 1, that is, can attain a long life, and can also improve its durability and safety.

Note that the headlamp 1 can be employed as a driving headlamp (high-beam headlamp) of an automobile or a passing headlamp (low-beam headlamp) of an automobile.

<Application Examples of the Present Invention>

A light emitting element (light emitting section 4) of the present invention is applicable not only to a vehicle headlamp but also to other illumination devices. For example, an illumination device of the present invention can be a downlight. The downlight is an illumination device attached to a ceiling of a structure such as a house or a vehicle. Instead, the illumination device of the present invention can be achieved as a headlamp for a moving object (e.g., a human, a ship, an airplane, a submersible, or a rocket) other than a vehicle. Further, the illumination device of the present invention can be achieved as a searchlight, a projector, or an interior illumination device (such as a stand light) other than the downlight.

EXAMPLE 1

Figure 10:
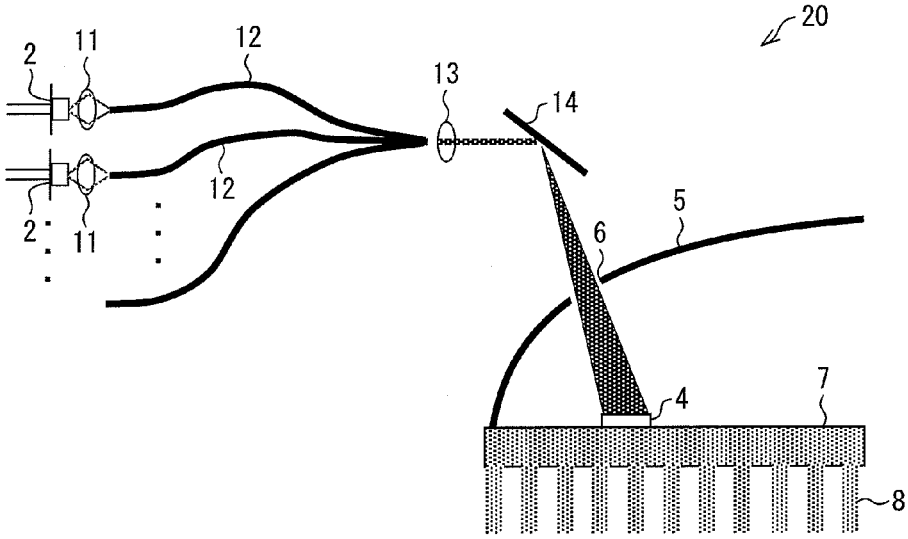
FIG. 10

The following description deals with concrete examples of the present invention with reference to FIG. 10. Note that members which are identical with members described in the foregoing embodiments have the same reference signs as those of the members described in the foregoing embodiments, and explanations of these are omitted here for the sake of simple explanation. Further, materials, shapes, and various values described below are merely examples, and the present invention is not limited to these.

FIG. 10 is a view schematically illustrating a headlamp 20 in accordance with an example of the present invention. As shown in FIG. 10, the headlamp 20 includes a plurality of sets each including a laser element 2 and a condenser lens 11, a plurality of optical fibers (light guiding members) 12, a lens 13, a reflecting mirror 14, a light emitting section 4, a parabolic mirror 5, a metallic base 7, and fins 8.

Each of the condenser lenses 11 is a lens for causing a laser beam emitted from a corresponding one of the laser elements 2 to be incident on an incident end section of a corresponding one of the optical fibers 12, which incident end section is one of edges of the corresponding one of the optical fibers 12. The plurality of sets each including the laser element 2 and the condenser lens 11 are provided for the plurality of optical fibers 12, respectively. Namely, the laser elements 2 are optically coupled with the optical fibers 12, respectively, via the respective plurality of condenser lenses 11.

Each of the plurality of optical fibers 12 is a light guiding member for guiding, to the light emitting section 4, a laser beam emitted from a corresponding one of the laser elements 2. The optical fiber 12 has a two-layer structure in which a center core is coated with a clad having a lower refractive index than that of the center core. The laser beam incident on the incident end section travels though the optical fiber 12, and then exits from an output end section, which is the other one of the edges of the optical fiber 12. The output end sections of the plurality of optical fibers 12 are bounded up with a ferrule or the like.

The laser beams emitted from the exit end sections of the respective plurality of optical fibers 12 are enlarged by the lens 13 so that the entire light emitting section 4, having an upper surface whose diameter is 2 mm, is irradiated with the laser beams. The laser beams thus enlarged are reflected by the reflecting mirror 14, so that an optical path of the laser beams is changed. Consequently, the laser beams are led to the light emitting section 4 through the window section 6 of the parabolic mirror 5.

(Details of Laser Element 2)

Each of the laser elements 2 emits a laser beam having a wavelength of 405 nm, and has an output of 1 W. The headlamp 20 includes eight laser elements 2 in total. Accordingly, a total output of these laser elements 2 is 8 W.

(Details of Light Emitting Section 4)

The light emitting section 4 contains a mixture of three kinds of fluorescent materials, i.e., RGB fluorescent materials, so as to emit white light. The red fluorescent material is $CaAlSiN_3$:Eu, the green fluorescent material is β-SiAlON: Eu, and the blue fluorescent material is $(BaSr)MgAl_{10}O_{17}$: Eu. Powders of these fluorescent materials are made into a film by means of, for example, electrophoresisis. The light emitting section 4 is, for example, a thin film having a square shape of side 2 mm and a thickness of 100 μm.

Note that, in this example, a laser beam enters from an upper surface side of the light emitting section 4 through the window section 6, and therefore the light emitting section 4 generates fluorescence and scattered light as shown in FIG. 1(*b*).

(Details of the Parabolic Mirror 5)

The parabolic mirror 5 has an opening 5*b* shaped in a half circle whose radius is 30 mm. The parabolic mirror 5 has a depth of 30 mm. The light emitting section 4 is provided at a focal point of the parabolic mirror 5.

(Details of Metallic Base 7)

The metallic base 7 is made from copper, and aluminum is vapor-deposited on a surface of the metallic base 7, on which surface the light emitting section 4 is to be provided. On a surface of the metallic base 7, which surface is opposite to the surface on which aluminum is vapor-deposited, the fins 8 each having a length of 30 mm and a width of 1 mm are provided at intervals of 5 mm. Note that the metallic base 7 and the fins 8 can be formed integral with each other.

(Effect of Headlamp 20)

The headlamp 20 includes the light emitting section 4 shown in FIG. 1(*b*). Therefore, the headlamp 20 can yield an effect identical to that yielded by the light emitting section 4, that is, can attain a long life, and can also improve its durability and safety.

<Another Expression of the Present Invention>

The present invention can be described as follows.

It is preferable to configure the light emitting element in accordance with an embodiment of the present invention such that the uneven shape have an arithmetic average roughness (Ra) of not less than 0.5 μm, and a maximum height (Ry) of not less than 1 μm. Further, it is preferable to configure the light emitting element in accordance with an embodiment of the present invention such that the coating layer have a thickness of not more than 30% of a particle diameter of the fluorescent material particles.

According to the configuration, it is possible to form an uneven shape capable of sufficiently reducing coherency of exciting light.

Note that the particle diameter of the fluorescent material particles is a median size (d50) of powdered fluorescent material particles that have not been accumulated, the median size being measured by laser diffraction/a scattering method. Note also that, in a case where the fluorescent material particles are covered with a binder, the thickness of the coating layer includes a thickness of the binder.

A light emitting device in accordance with an embodiment of the present invention, including: the above-described light emitting element; and an excitation light source for emitting the exciting light.

According to the configuration, since the light emitting device includes the light emitting element, it is possible to produce a light emitting device excellent in safety, as with the light emitting element, even in a case where the coherency of the exciting light emitted from the excitation light source is high.

A vehicular headlamp and an illumination device in accordance with an embodiment of the present invention, including the above-described light emitting device. It is therefore possible to produce a vehicular headlamp and an illumination device excellent in safety, as with the light emitting device.

The present invention can be further described as follows.

An illumination device (light emitting element) in accordance with an embodiment of the present invention is configured to emit light from a fluorescent material upon irradiating, with LD light (laser beam), a film of the fluorescent material in which fluorescent material particles are accumulated on a metal substrate by means of electrophoresis or sedimentation, and then each of the fluorescent material particles is coated with a transparent inorganic coating material while unevenness of the fluorescent material particles are kept.

The illumination device in accordance with an embodiment of the present invention can be configured to simultaneously employ the light from the fluorescent material, and LD light scattered by a surface of the fluorescent material without exciting the fluorescent material.

The present invention is not limited to the description of the embodiments above, and can therefore be modified by a skilled person in the art within the scope of the claims. Namely, an embodiment derived from a proper combination of technical means disclosed in different embodiments is encompassed in the technical scope of the present invention.

Industrial Applicability

The present invention is applicable to a light emitting device or an illumination device, particularly applicable to a headlamp for a vehicle or the like. The present invention makes it possible to attain a long life, and improve durability and safety.

REFERENCE SIGNS LIST

1: headlamp (light emitting device, vehicular headlamp, illumination device)
2: laser element (excitation light source)
4: light emitting section (light emitting element)
40: fluorescent material particle
42: coating layer
43: uneven shape
45: metal substrate (substrate)

The invention claimed is:

1. A light emitting element, for emitting fluorescence upon receiving a laser beam emitted from an excitation light source, the light emitting element comprising:

a plurality of fluorescent material particles made from a single type of fluorescent material or several types of fluorescent materials, the plurality of fluorescent material particles being accumulated on a substrate to form a layer of the plurality of fluorescent material particles, each of the plurality of fluorescent material particles having a surface coated with a coating layer, the coating layer causing the plurality of fluorescent material particles to adhere to each other, the coating layer forming an uneven shape of a surface of the light emitting element, gaps being formed between the plurality of fluorescent material particles each of which has the surface coated with the coating layer, and the laser beam being incident on the uneven surface of the light emitting element so that the florescence is emitted from the uneven surface.

2. The light emitting element as set forth in claim 1, wherein:

the uneven shape has an arithmetic average roughness (Ra) of not less than 0.5 μm, and a maximum height (Ry) of not less than 1 μm.

3. The light emitting element as set forth in claim 1, wherein:

the coating layer has a thickness of not more than 30% of a particle diameter of the fluorescent material particles.

4. A light emitting device, comprising:

a light emitting element recited in claim 1; and an excitation light source for emitting the laser beam.

5. A vehicular headlamp, comprising a light emitting device recited in claim 4.

6. An illumination device, comprising a light emitting device recited in claim 4.

7. The light emitting element as set forth in claim 1, where the laser beam is incident on the uneven surface of the light emitting element at an incident angle of not less than 32°.

8. A method for producing a light emitting element for emitting fluorescence upon receiving a laser beam emitted from an excitation light source, the method, comprising the steps of:

accumulating a plurality of fluorescent material particles made from a single type of fluorescent material or several types of fluorescent materials on a substrate so as to form a layer of the plurality of fluorescent material particles;

coating each of surfaces of the plurality of fluorescent material particles with a coating layer so as to cause the plurality of fluorescent material particles to adhere to each other and so as to form an uneven shape of a surface of the light emitting element, in such a manner that gaps are formed between the plurality of fluorescent material particles each of which has the surface coated with the coating layer, and configuring the light emitting element such that the laser beam is incident on the uneven surface of the light emitting element so that the florescence is emitted from the uneven surface.

9. A light emitting element, for emitting fluorescence upon receiving a laser beam emitted from an excitation light source, the light emitting element comprising:

a plurality of fluorescent material particles made from a single type of fluorescent material or several types of fluorescent materials, the plurality of fluorescent material particles being accumulated on a substrate to form a layer of the plurality of fluorescent material particles, each of the plurality of fluorescent material particles having a surface coated with a coating layer, the coating layer forming an uneven shape of a surface of the light emitting element, and the laser beam being incident on the uneven surface of the light emitting element so that the florescence is emitted from the uneven surface.

10. The light emitting element as set forth in claim 9, where the laser beam is incident on the uneven surface of the light emitting element at an incident angle of not less than 32°.

* * * * *